United States Patent [19]

Wright

[11] Patent Number: 5,031,784

[45] Date of Patent: Jul. 16, 1991

[54] ONE-PIECE CHILD-RESISTANT CLOSURE

[76] Inventor: Frank S. Wright, 6220 Shallowford Rd., Apt. 123, Chattanooga, Tenn. 37421

[21] Appl. No.: 501,530

[22] Filed: Mar. 30, 1990

[51] Int. Cl.[5] ..... B65D 55/02

[52] U.S. Cl. ..... 215/216; 215/237; 215/245; 215/211; 220/283

[58] Field of Search ..... 215/216, 211, 235, 237, 215/224, 225, 245; 220/283, 339, 375

[56] References Cited

U.S. PATENT DOCUMENTS

| | | | |
|---|---|---|---|
| 3,623,622 | 11/1971 | Sullivan | 215/216 X |
| 3,826,394 | 7/1974 | Stull | 215/211 X |
| 4,170,315 | 10/1979 | Dubach et al. | 220/281 |
| 4,420,089 | 12/1983 | Walker et al. | 215/216 |
| 4,424,910 | 1/1984 | Heinol | 215/216 |
| 4,501,378 | 2/1985 | Berfield | 220/324 |
| 4,629,081 | 12/1986 | McLaren | 215/206 |
| 4,787,526 | 11/1988 | Pehr | 215/216 |
| 4,917,261 | 4/1990 | Borst | 220/324 |
| 4,925,041 | 5/1990 | Pehr | 215/216 |

*Primary Examiner*—Stephen Marcus
*Assistant Examiner*—Stephen K. Cronin

[57] ABSTRACT

A one-piece closure includes a bottom member adapted to engage over the neck portion of a container and a top lid member that rotates between a closed position where it engages the mouth of the bottom member and an open position on an integral hinge. An elongate arm includes a distal end hook that engages a ledge on the top lid to hold the top lid open but, when depressed allows the top lid to be opened. The elongate arm can only be depressed by using the thumb or a finger and the top lid cannot be grasped except be the area hidden by the elongate hook.

16 Claims, 6 Drawing Sheets

ONE-PIECE CHILD-RESISTANT CLOSURE

BACKGROUND

1. Field of the invention

The present invention relates to one-piece closures having radially depressable child-resistant means adapted to release a top lid member from a bottom lid member.

2. Description of the prior art

One-piece closures are known in the prior art and use a bottom member adapted to engage the neck portion of a container and a top lid member adapted to seal the container when in the closed position. The two members are fixedly attached by hinge means located at the rear of the closure such that the top lid member is free to rotate from a closed to an open position. The hinge means may either be a continuous strap connecting the members, a strip hinge or a unitary hinge adapted to hold the top lid member in either of a closed or fully open position. Such closures are widely used as dispensing closures for various liquids—because of their low manufacturing cost and customer acceptance—by providing the bottom skirt member with a planar end skirt to close the container and providing the planar end with a dispensing orifice, but the closures cannot be adapted for use on containers holding products where a child-resistant closure must be used. The Poisoning Prevention Packaging Act of 1970 stipulates that certain substances such as medicines, for example, be packaged in special (child-resistant) packaging and sets forth protocols to evaluated such packaging. Under the aforementioned Act, dispensing closures cannot be used on containers holding the listed substances because they fail the standard protocols.

It is known in the prior art to provide unitary closures with child-resistant means so that the closures may be used with special packaging. U.S. Pat. No. 4,209,100 to Uhlig discloses a resiliantly flexible portion of the bottom member skirt that ordinarily blocks access to the top lid, but, when pressed radially inward allows the user to insert a finger-nail between the bottom and top members and pry the top lid member open. It has been noted in several studies however, that even small children are adept at performing simple tasks.

It is also known in the prior art to provide a latch assembly between the lid and bottom members of a unitary closure to hold the lid member in a closed position. The latch assembly includes a hook on the terminus of a moveably attached resiliantly flexible member on one of the members of the closure such that the hook engages thereover a ledge formed on the other of the members to hold the top lid member in a closed position. It is known to provide such a resiliantly flexible member with a hook attached to the lid member such that the resilient portion must be pressed radially inward to disengage the hook from a ledge on the bottom portion as shown by U.S. Pat. No. 4,244,495 to Lorscheid et al., and U.S. Pat. No. 4,170,315 to Dubach et al.

A resilient member that operates in the same manner but which must be pulled radially outward to disengage the hook is shown by U.S. Pat. No. 4,022,352 to Pehr and U.S. Pat. No. 4,533,058 to Uhlig.

Another method of providing a unitary closure with a resiliantly flexible member is known, in the prior art as illustrated by U.S. Pat. No. 4,629,081 to McLaren. McLaren employs a resiliantly flexible portion of the bottom member skirt that is held in a radially outer position by an annular ring formed on the neck of an associated container. The closure may be rotated to a particular angular alignment wherein a gap in the annular ring allows the flexible member to be depressed disengaging the hook portion. However, child-resistant closures that employ a specially designed container limits their marketability.

It is also known in the prior art to provide a resiliantly flexible member that is not fixedly attached to either member of the closure rather articulates the flexible member thereto via a live hinge instead allowing the perpendicular portion of the hook to be formed parallel to the axis of the closure. U.S. Pat. No. 4,787,526 to Pehr illustrates such child-resistant means. Pehr discloses a member that may be formed at a right angle to the axis of the closure and thereafter folded to the child-resistant position. In the child-resistant position, the bottom portion of the flexible member abuts a second surface so that the hook is held in an outward position until inward pressure applied to the flexible portion bends it over the top of the second surface releasing the hook. One problem with this procedure is that the finger or thumb that is used to bend the hook backwards interferes with pulling up on the lid. Too, once open, the flexible portion rotates downward into an inoperable position, so the user must fold the hook back into the CR position before closing. CR means of this type are referred to as 'active' by the CR manufacturing industry (ie. requiring the user to do something to achieve CR) thus limiting their use.

SUMMARY OF THE INVENTION

It is an object of the present invention to provide a one-piece closure that is child-resistant. The present invention is a one-piece closure including a bottom skirt portion adapted to be secured to the neck portion of a container and a lid member adapted to seal the open mouth portion of a container as the main components thereof. The main components of the closure are hingedely attached to one another such that the lid portion may be rotated from a closed position wherein it seals the mouth portion of the container to an open position wherein the contents of the container may be accessed through the mouth of the container. The lower skirt portion includes two projections flush with the exterior wall of the skirt at their base and extending axially upward therefrom such that the projections are at an acute angle to the axis of the closure. The projections include interior side walls essentially parallel to a radial plane of the closure such that they form an open area between each other and the bottom skirt member. Hingedely attached to the bottom skirt at the base of the projections, a radially inwardly flexible member is held in a position flush with the front of the projections. A hook shaped projection at the top of the flexible member is adapted to engage a lip on the inner surface of the top lid member when the lid member is in the closed position. Means supplied between the flexible member and the bottom portion skirt maintains the hook projection engagement with the lip until the user applies radially inwardly directed force thereto the flexible member to move the hook backward to clear the lip wherein the top lid member may be rotated about the hinge to the open position.

It is a further object of the present invention to provide a one-piece closure with 'passive' child-resistant means; means that are automatically reactivated as the closure is placed on a container. While radially inwardly directed force applied thereto the flexible portion moves the hook projection inward, removing the force causes the hook projection to move radially outward to the first position because of resilient means between the bottom member skirt and flexible member. One manner of providing resilient means is outlined in my Invention Disclosure Document, No. 191824 filed Apr. 28, 1988, and shows how the degree of resiliency may be determined by the amount of lateral deformation of a portion of the flexible member as it is forced into a 'V' or 'C' shaped channel formed by the two vertical projections. The resilient means hold the flexible member radially outward so as to cause the hook portion to interfere with the top lid lip as the top lid member is closed, but the hook portion is formed with a slanted top surface that, in conjunction with a slot below the hook, causes the hook to bend backward until it clears the lip as the top lid member is closed. Thus, the child-resistant function of the closure is 'passive' and requires no action by the user to return the closure to a child-resistant configuration as the top lid member is closed.

Yet a further object of the present invention is to provide a child-resistant closure that may be used on any type of container. The closure is secured to a container neck portion via means formed on the bottom skirt member of the closure. Such securing means may include screw-threads adapted so that the closure is not easily removed once applied to a container. Other means may include a simple tongue and groove arrangement between the closure skirt and container whereby the closure may be snapped into position. The method used to secure the closure to a container does not affect the child-resistant function of the closure thereby eliminating the need to use a specially designed container.

Still a further object of the present invention is to provide a child-resistant closure that may be used on containers holding either solid or liquid materials. The closure bottom skirt member is adapted to provide a moisture resistant tight seal thereover the open mouth of a container when the closure is applied. The closure top lid member is adapted by means of an annular sealing ring formed therein the top lid member bottom surface to provide a moisture resistant tight seal with the bottom skirt member when the top lid member is in the closed position. This seal may be adapted to provide a sealing engagement directly thereinto the mouth of the container. In some situations such as when a container holds solids in large granular or capsule forms the latter means may be acceptable, but when a container holds liquids, powders or small solid granular forms of material the former means have to be employed because material getting in-between the bottom skirt member and container would be a problem. The closure may also be used for dispensing liquids from blow-molded plastic squeeze bottles by providing the bottom skirt member with a planar top surface fitted with a dispensing orifice It is still a further object of the present invention to provide a unitary child-resistant closure that is relatively easy and inexpensive to manufacture. It is known in the prior art to use a plastic material, such as polypropolyne, as a means of simplifying the molding of complex plastic parts. A complex plastic part may be molded by a single 'pull' type mold (ie. a mold without a collapsible core) by incorporating a 'live hinge' so that undercuts maybe formed parallel to the axis of the mold. Thereafter, the plastic part is folded and snapped into its final form. The hook portion of the flexible member has a surface that is at a right angle to the axis of the closure which would ordinarily be difficult to form without using a expensive mold, but may be formed with a straight pull mold because the flexible member is formed at a right angle to the axis of the closure. After the closure is formed, the flexible member is snapped into the channel formed by the two vertical projections and is prevented from being removed from this position by two chisel shaped tabs that snap behind the interior front walls of the projections.

It is still a further object of the present invention to provide a closure that is relatively easy for adults to use while being relatively difficult for children to operate. The closure is in and of itself difficult for small children to discover how to operate because the closure is not removed from a container, rather it has a lid that rotates upward to an open position. However, in actual use, children will notice how the lid opens but, because the thumb covers the flexible member, will not easily determine how the lid is unlatched. It is known from required test protocols that children often use their teeth when trying to open child-resistant packaging. To resist this, the present invention employs a lip adjacent to the inwardly flexible portion that prevents the flexible portion from being depressed by any means other than pushing straight in without contacting the adjacent lip. The present invention may also use an obstructive lip therebetween the bottom member skirt and flexible portion such that it interferingly abuts the flexible portion as it is pushed straight in. In order to fully depress the flexible portion to disengage the hook, it would be necessary to press in and then to the side opposite the obstruction, such as, by way of example, pushing in then to the left.

Other objects advantages and features of the present invention will become apparent to those ordinarily skilled in the art from the following detailed description taken in conjunction with the annexed drawings, wherein, by way of example, certain preferred embodiments of the present invention are illustrated.

DESCRIPTION OF THE PREFERRED EMBODIMENTS

Figure 1:
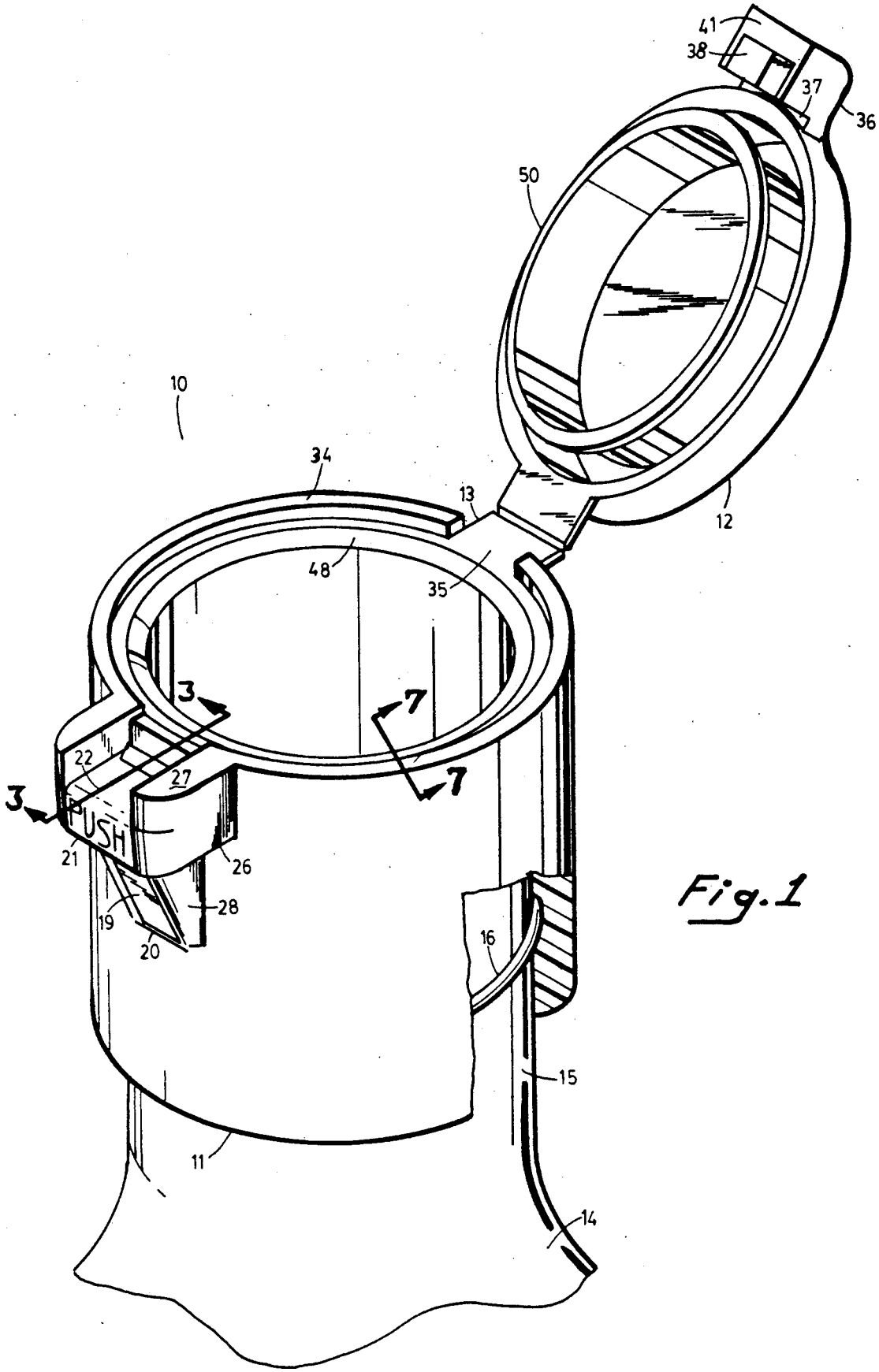
FIG. 1 is a perspective view of the closure of the present invention with a portion of the bottom member skirt sectioned to show closure-container engagement means.
Figure 2:
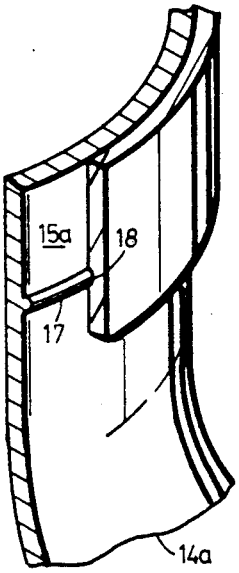
FIG. 2 is a fragmentary view of the sectioned portion of FIG. 1 but showing alternate closure-container engagement means.

With reference to the drawings wherein like numerals designate like parts and referring first to FIG. 1, there is shown a one-piece child-resistant closure 10 including a bottom skirt member 11 and a lid member 12 as the main components thereof. Lid member 12 may rotate upwardly from a closed to an open position about hinge member 13. Hinge member 13 may be either a continuous plastic strap, a live hinge, or a toggle type hinge that holds the lip in either of a closed or open position. Any type of hinge that is used is continuous with and secured thereto skirt 11 and lid 12 allowing lid 12 to be rotated between open and closed positions while remaining attached to bottom skirt 11. Closure 10 is secured thereto container 14 by cooperative engagement means therebetween closure skirt 11 and container neck portion 15. It is illustrated in FIG. 1 that container neck portion 15 includes screw-threads 16 to engage closure skirt 11 but as will become apparent in the following detailed description, any means to secure the closure of the present invention to a container may be used. FIG. 2 shows a simple tongue 17 and groove 18 arrangement whereby closure 10 is snapped onto neck 15*a* of container 14*a*.

Figure 3:
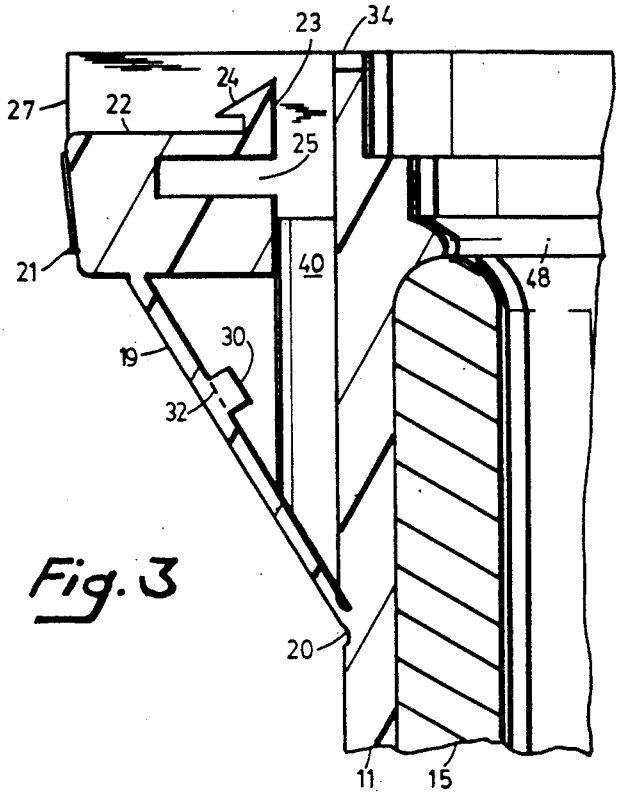
FIG. 3 is a partial sectional view of the front portion of the bottom member of the closure taken along line 3—3 in FIG. 1.

Referring to FIG. 3, radially inwardly flexible elongate arm 19 is hingedly secured thereto skirt 11 by live hinge 20. Elongate arm 19 has a top portion 21 with a planner top surface 22 and a hook 23 upstanding from a radially inward position on top portion 21. Hook 23 includes a top surface 24 tapered downward and radially outward, the function of which will be presently described along with the function of slot 25 formed therein the radially interior surface of top portion 21.

Figure 4:
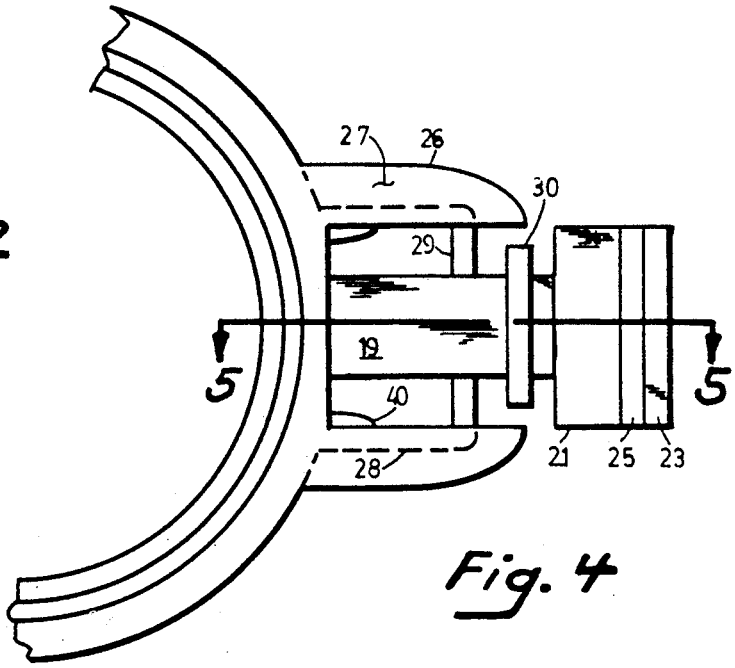
FIG. 4 is a plan view of the front portion of the bottom member shown with the flexible arm in its inital position.

As seen most clearly in the plan view of FIG. 4, bottom skirt member 11 includes two opposing vertical projections 26, each of which is comprised of a top portion 27 and a bottom portion 28 (FIG. 1). The open area between top portions 27 is adapted to receive elongate arm top portion 21 while the open area between bottom portions 28 is adapted to receive elongate arm 19.

Figure 5:
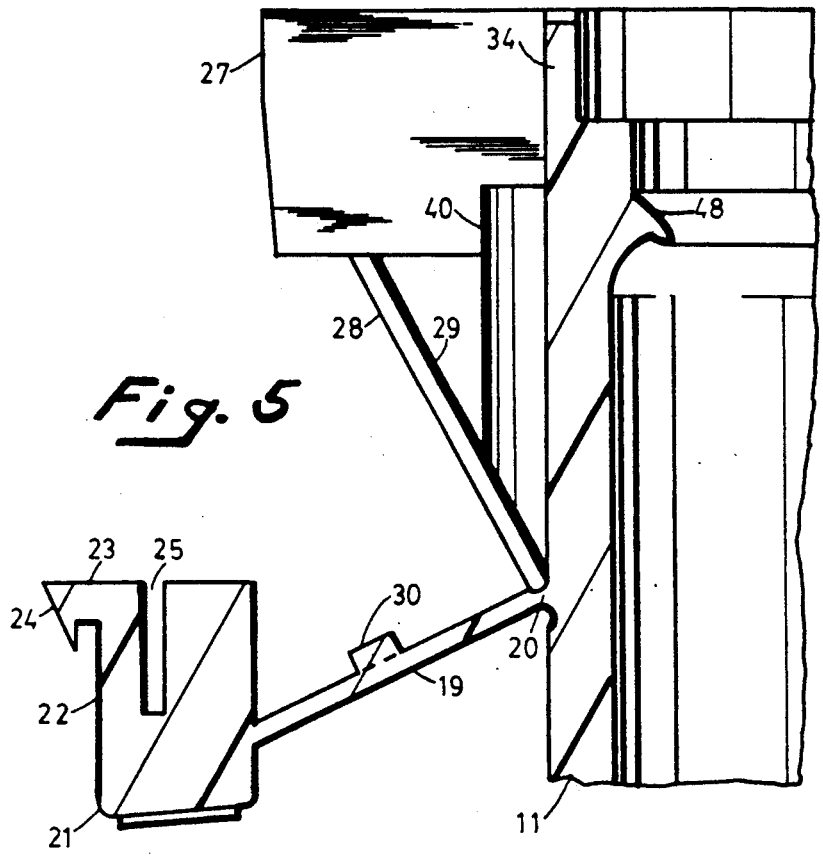
FIG. 5 is a partial sectional view similar to FIG. 3 but taken along line 5—5 of FIG. 4.
Figure 6:
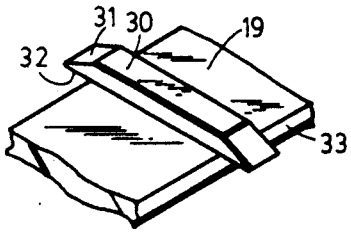
FIG. 6 is a fragmentary perspective view of a portion of the flexible arm showing the retaining tabs that prevent the flexible arm from moving outward after the flexible arm is folded into its permenant position.
Figure 7:
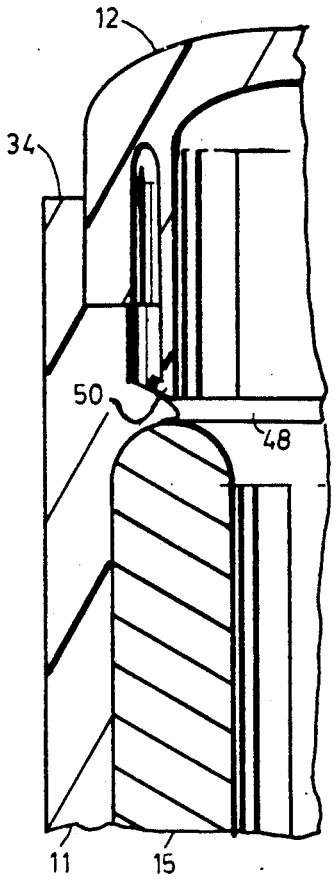
FIG. 7 is a sectional view taken along line 7—7 in FIG. 1.

Bottom portions 28 taper upwardly and radially outwardly from bottom skirt member 11 and is flush therewith at the same elevation where hinge 20 adjoins elongate arm 19 to skirt 11. It is noted that elongate arm 19 and bottom members 28 are disjoint, and further, that bottom members 28 are formed so as to create a channel of equal width with elongate arm 19. Members 28 have an interior front surface 29 so that the members, in plan, are formed in the manner of two opposing claws (FIG. 4). Elongate arm 19 includes a retaining tab 30 formed on its rear surface (FIGS. 5,6). As shown in FIG. 6 tab 30 extends outward from either side of elongate arm 19 and includes a rear tapered surface 31 and a front planar surface 32. After the closure is made, elongate arm 19 is folded in the direction of the arrow in FIG. 5 and tapered surfaces 31 snap behind the interior front surfaces 29 of members 28 where flat planar surfaces 32 abut surfaces 29 and prevent arm 19 from moving radially outward past the position illustrated in FIG. 3. It is desirable to have thickness 33 of elongate arm 19 equal the thickness of front interior wall 29 of members 28 so that elongate arm 19 is flush with the front of members 28 when the closure is in a child-resistant position. It should be noted that the function of vertical projections 26 having a top portion 27 is to prevent access to top portion 21 by means other than use of a thumb or finger; (it has been noted in protocol testing of other types of child-resistant closures that children do sometimes use teeth in attempting to open a closure and are told they may use their teeth during the test). In the preferred form of the present invention, top portion 27 will prevent 'biting' as a successful means of opening the closure.

Figure 8:
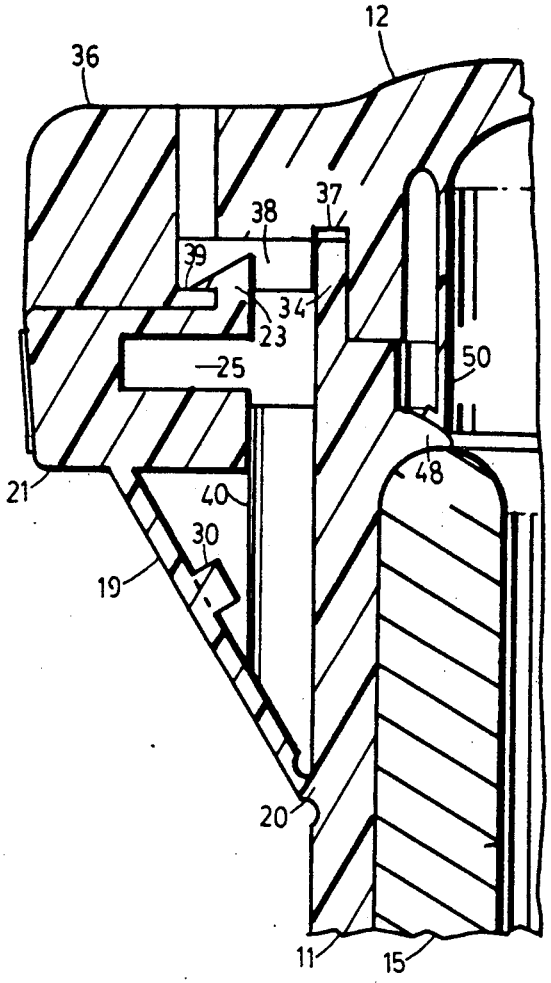
FIG. 8 is a sectional view similar to FIG. 3 but showing the top lid member in its closed position.

Lid member 12 is received within annular wall 34 of skirt 11 as a means of blocking access to a surface on lid 12 that could be used to pry open the closure without depressing elongate arm 19. Annular wall 34 has an opening 35 at a point essentially aligned with the radial plane of hinge 13 but is otherwise continuous around the circumference of the mouth of closure 10. Opening 35 allows lid member 12 to be rotated about hinge 13 into the open mouth of closure 10 as defined by annular wall 34. Lid 12 further includes front tab 36 adapted to be received therein the opening therebetween top portions 27 of vertical members 26. Slot 37 of tab 36 is provided so that there is unobstructive clearance therebetween the tab and annular wall 34. It is also shown in the cross sectional view of FIG. 8, that tab 36 includes an opening 38 that forms a ledge 39 that hook 23 of elongate arm 19 captures when lid 12 is in a closed position. It would be necessary to provide tab 36 with an opening above ledge 39 to facilitate inexpensive manufacture of the closure.

Figure 9:
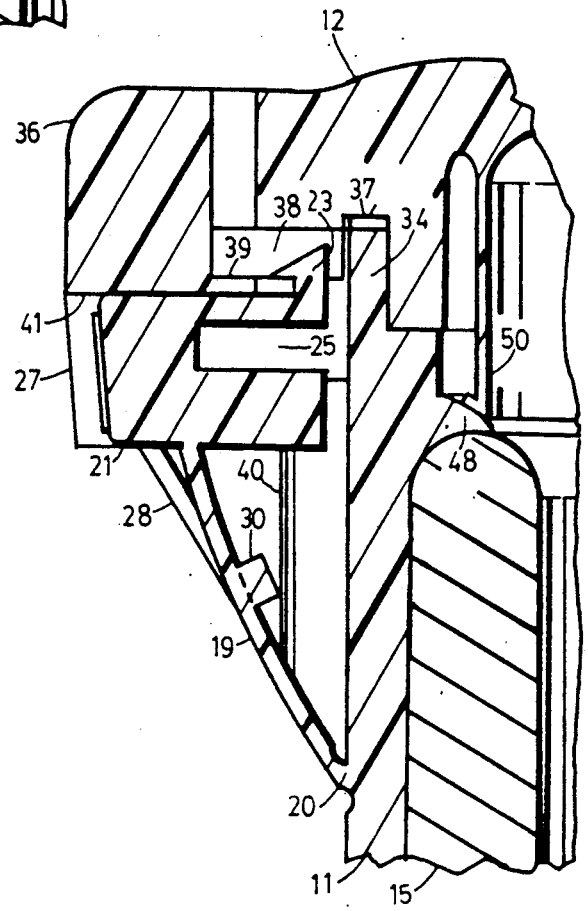
FIG. 9 is a view similar to FIG. 8 but showing the relative position of the flexible arm when it is fully depressed.
Figure 10:
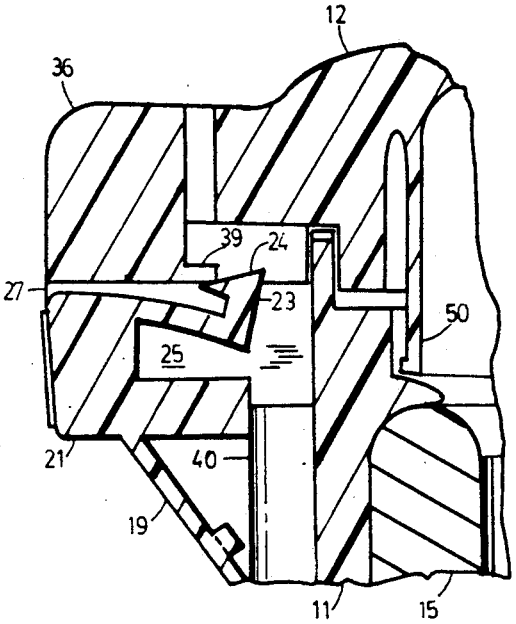
FIG. 10 is a view similar to FIG. 8 but showing the top lid member as it is being pushed down into its closed position.

It is shown in FIGS. 3,4, and 5 that the open area defined by opposing vertical projections 26 includes surfaces 40 tapered radially inward that present an obstructive surface to inward movement of top portion 21 of elongate arm 19 and are formed to urge elongate arm 19 to remain in the radially outward position. By pushing top portion 21 of elongate arm 19 inward, hook 23 moves inward past ledge 39 in tab 36 (FIG. 9) and top lid 12 can be rotated to an open position by pushing up on exposed surface 41 of tab 36. It should be noted that surfaces 40 provide resiliency to elongate arm 19 by transferring inward motion to lateral deformation of top portion 21, and, as such, can be considered camming surfaces. The use of camming surfaces relative to movement when used with child-resistant means are more fully explained in U.S. Pat. No. 4,729,487 to Wright. The camming surfaces of the present invention may be formed either vertically or horizontally on either of elongate arm 19 or bottom member 11 with a cam-follower surface on the other of the members. However, when lid 12 is being returned to the closed position (FIG. 10), there is obstructive relative positioning between hook 23 and bottom surface 41 of tab 36 because surfaces 40 inbetween vertical projections 26 urge elongate arm 19 to remain in a radially outward position. Hook 23 includes tapered top surface 24 in order for the hook to be forced backwards when surface 24 encounters bottom surface 40 of tab 36. Slot 25 of top portion 21 is provided to allow hook 23 to yeildingly bend down as well as backwards as illustrated in FIG. 10.

Figure 11:
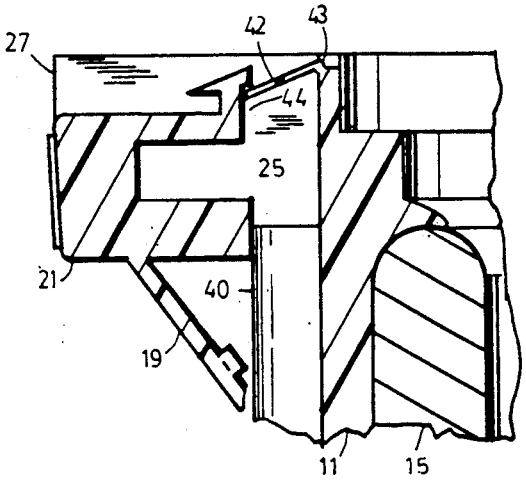
FIG. 11 is a fragmentary section view similar to FIG. 3 but showing a piece of trim between the top of the bottom member of the closure and the hook to hide the space between them.

In the case where the closure is used on a container holding solids in small granular or powder form, a modification of the present invention may be used to prevent the material from falling in-between hook 23 and the interior space formed by upstanding members 26 and bottom member 11. According to the modification, flap 42 (FIG. 11) is secured to either of hook 23 or annular wall 34 by live hinge 43, the function of which is similar to the function of live hinge 20 in that it allows flap 42 to be formed perpendicular to the axis of the closure and thereafter folded into position. It would be desirable to provide flap 42 articulated to annular wall 34 and folded downward to engage thereunder slot 44 in hook 23 such that the flap rotates downward and upward along with the hook.

Figure 12:
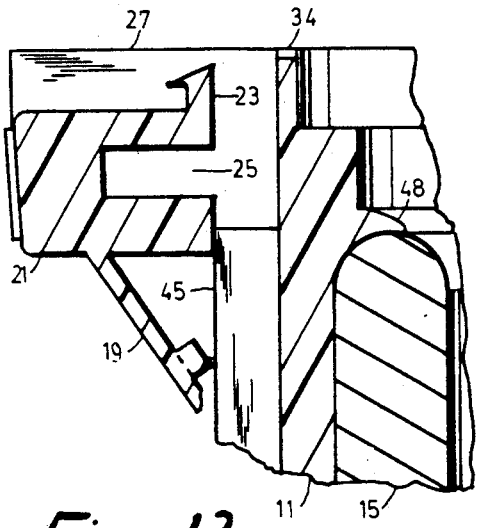
FIG. 12 is a view similar to FIG. 11 but taken along line 12—12 in FIG. 13 showing obstructive means between the flexible arm and the bottom member.
Figure 13:
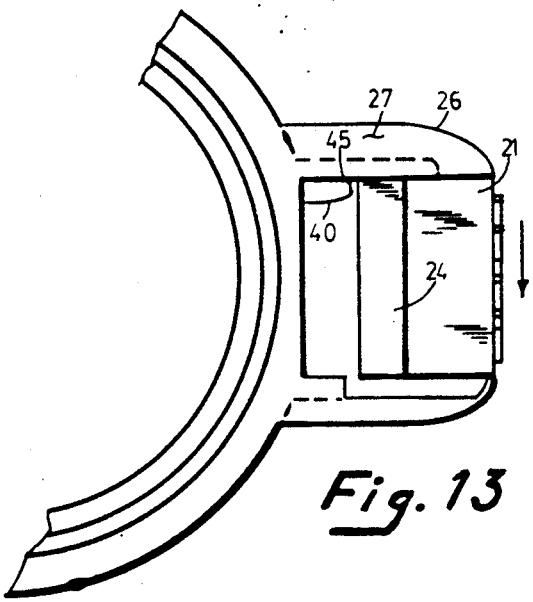
FIG. 13 is a partial plan view similar to FIG. 4 but showing the obstructive means between the flexible arm and the bottom member of the closure of the present invention.

A further modification of the present invention would make the closure more difficult for children to operate especially when the closure is made in larger sizes. According to the modification shown in FIGS. 12 and 13, flat obstructive surface 45 abuts the rear of top portion 21 of elongate arm 19 as portion 21 is depressed making it necessary to push top portion latterly to the side opposite surface 45, as shown by the arrows in FIG. 13, in order for top portion 21 to be completely depressed allowing hook 23 to clear opening 38.

Figure 14:
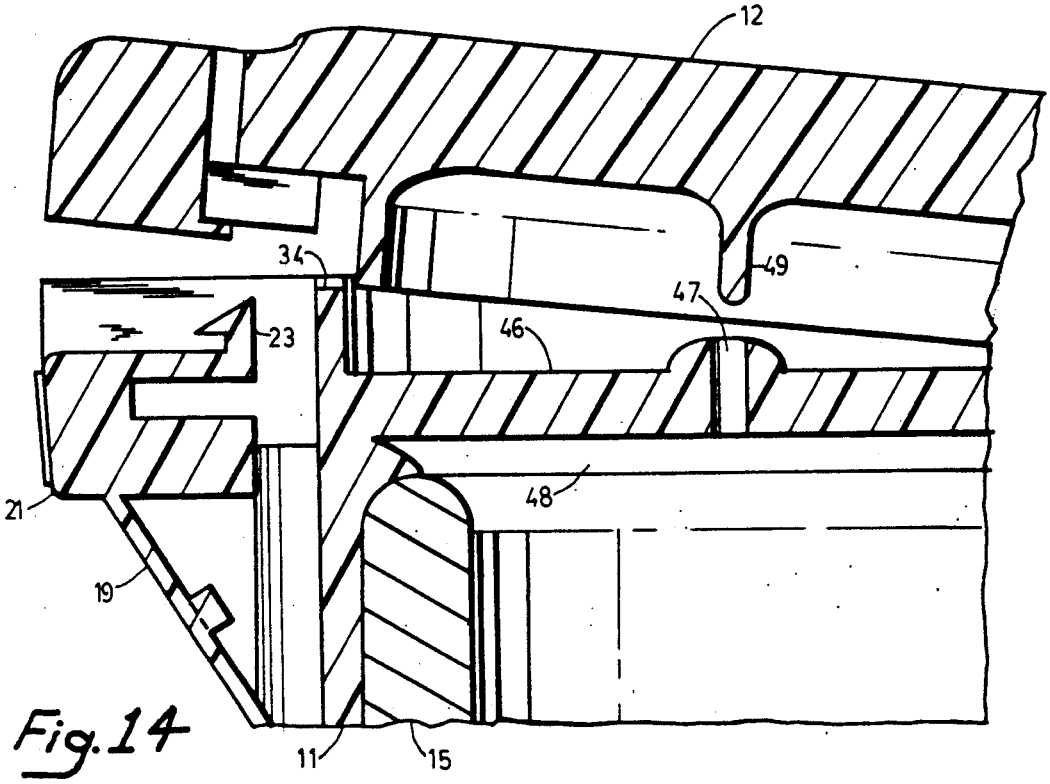
FIG. 14 similar to FIG. 10 but showing modifications to the bottom and top members of the present invention so the closure may be used for dispensing liquids.

The present invention is useful on containers holding solid material as previously discussed and may also be modified to dispense liquids from blow-molded plastic containers. Accordingly, it would be necessary to provide a planner top deck 46 (FIG. 14) to reduce the open mouth of the closure to a dispensing orifice 47 through which a liquid may be dispensed. As with the case of each of the previously discussed forms of the present invention, annular sealing ring 48 depends into the mouth portion of the container to provide a moisture-resistant seal therewith but the manner in which the top lid member seals the bottom member should be noted. With the liquid-dispensing form of the present invention, lid 12 includes a depending plug 49 adapted to engage therein dispensing orifice 47 when lid 12 is in a closed position as a means of sealing the orifice. Referring again to the closure illustrated in FIGS. 1–12, it can be seen that lid 12 includes a depending apron 50 that abuts annular sealing ring 48 when the lid is in a closed position. Having a means that maintains a moisture resistant seal with a container when the lid member is in either of a closed or open position, is provided so that material, especially solids in small granular and powder forms, do not cake-up or otherwise collect around the closure-container joint because of moisture that would collect if the top lid engaged directly with the container.

Figure 15:
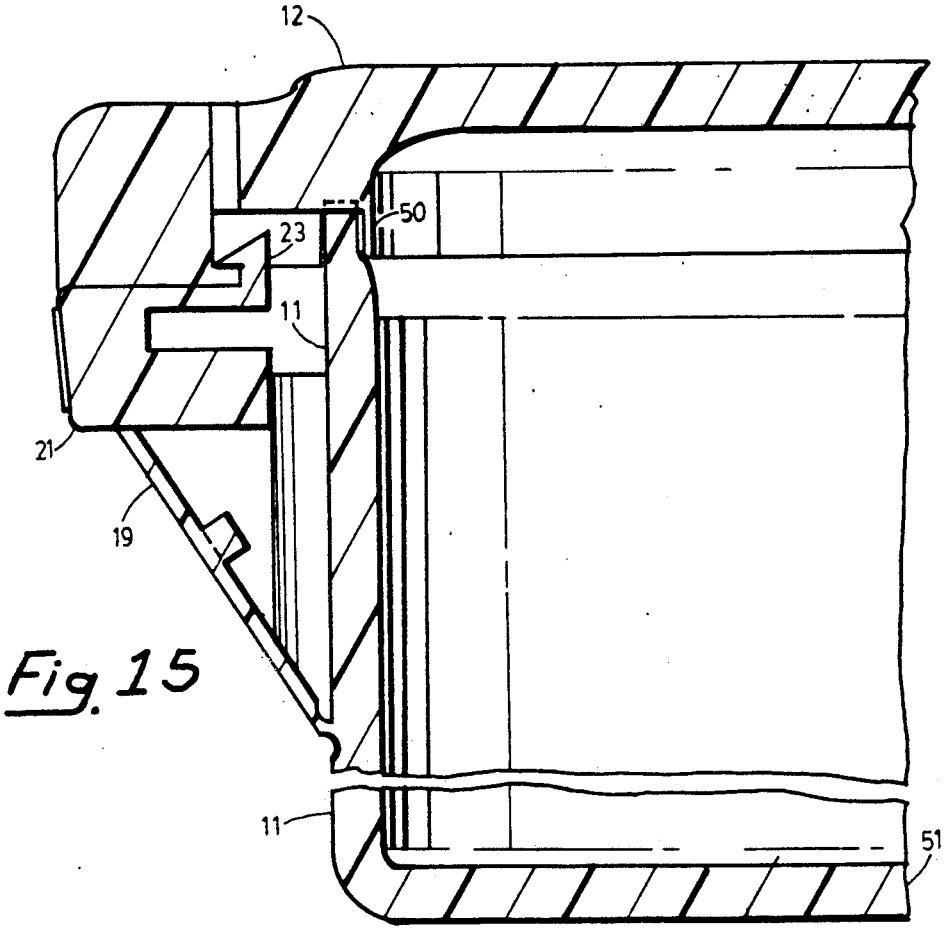
FIG. 15 is a sectional view of a modification of the present invention to provide a one-piece child-resistant container.

The present invention may be further adapted to provide a one-piece child-resistant container. When bottom skirt member 11 is provided with an end wall 51 as shown in FIG. 15, the bottom member is a container. Therewith this modification, annular sealing ring 48 may be omitted as unnecessary and depending apron 50 of lid member 12 may seal directly against the interior wall of the container.

It should be understood that the various terms and expressions used in the foregoing specification and illustrated in the accompanying drawings, are illustrative and explanatory thereof, and there is no intention in the use of such terms and expressions of excluding any equivalents of the features shown or described. It will be appreciated by those skilled in the art, that various modifications of the parts, or the portions thereof, may be made within the scope and spirit of the invention.

I claim:

1. A one-piece child-resistant closure having a central longitudinal axis comprising;

a bottom member including an annular side wall, said bottom member adapted for engagement over a neck portion of a container, said bottom member including a mouth portion;

a top lid member adapted to engage therein said bottom member mouth portion when said top lid member is in a closed position;

hinge means connecting said bottom and top lid members, said hinge means adapted to allow said top lid member relative axial outward movement as said top lid member is urged from a closed to an open position, said hinge means adapted to be formed co-jointly with said bottom and top lid members said bottom member including an elongate arm articulated to said bottom member side wall on one end to provide a pivot whereby said elongate arm may be rotated from a position essentially perpendicular to said axis of the closure to a position at an acute angle to the axis of said closure;

said bottom member annular side wall including an exterior surface with a channel formed therein, the channel adapted to movably receive said elongate arm and to provide unobstructive clearance thereto to allow said elongate arm inward movement, said channel including a front interior wall;

said elongate arm including obstructive means formed thereon to engage behind said channel front interior wall when said elongate arm is folded into said channel to obstruct relative radial outward movement of said elongate arm radially outward beyond said bottom member channel;

means formed thereon either of said elongate arm or bottom members adapted to direct radial inward force applied thereto said elongate arm for deformation of either of said elongate arm or bottom members, said means to direct radial inward force adapted to yieldingly urge said elongate arm towards a relative radial outward position;

means formed thereon said top lid member adapted to provide a surface whereby said top lid member may be rotated to an open position, said top lid member means adapted to be accessible to a user only when said elongate arm is depressed.

2. A one-piece child-resistant closure having a central longitudinal axis, comprising;

a bottom member including an annular side wall, said bottom member adapted for engagement over a neck portion of a container, said bottom member including a mouth portion;

a top lid member adapted to engage therein said bottom member mouth portion when said top lid member is in a closed position;

hinge means connecting said bottom and top lid members, said hinge means adapted to allow said top lid member relative axial outward movement as said top lid member is urged from a closed to an open position, said hinge means adapted to be formed co-jointly with said bottom and top lid members;

said bottom member including an elongate arm articulated to said bottom member side wall on one end to provide a pivot whereby the elongate arm may be rotated from a position essentially perpendicular to said axis of the closure to a position at an acute angle to said axis of said closure, said elongate arm including a distal hook on said terminus thereof;

said bottom member annular side wall including an exterior surface with a channel formed therein, said channel adapted to movably receive said elongate arm and to provide unobstructive clearance thereto to allow said elongate arm inward movement, said channel including a front interior wall;

said elongate arm including obstructive means formed thereon to engage behind said channel front interior wall when said elongate arm is folded thereinto said channel to obstruct relative radial outward movement of said elongate arm radially outward beyond said bottom member channel;

means formed thereon either of said elongate arm or bottom members adapted to direct radial inward force applied thereto said elongate arm for deformation of either of said elongate arm or bottom members, said means adapted to yieldingly urge said elongate arm towards a relative radial outward position;

engagement means formed thereon said top lid member adapted to be engaged by said elongate arm hook when said top lid member is in a closed position, said top lid member engagement means adapted to disengage said elongate arm hook when said elongate arm is depressed radially inward, said top lid member engagement means adapted to provide unobstructive access to a portion thereof when said elongate arm is depressed radially inwards so said top lid member may be urged axially outward to an open position

3. The child-resistant closure as set forth in claim 2, wherein;

said bottom side wall channel is formed by two upstanding opposing structures formed radially outward and axially upward from a position where said elongate arm adjoins said bottom member sidewall, said opposing structures formed so as to provide an open space between them equidistant with the width of said elongate arm such that said elongate arm is movably received in said open space, said opposing structures formed with a radially outward wall having equal thickness with said elongate arm.

4. The child-resistant closure as set forth in claim 2, wherein;

said elongate arm obstructive means includes at least one tab extending laterally outward therefrom said interior wall of said elongate arm, said tab having a planner radial outward front surface and a back surface tapered radially inward and laterally inward from the outer edge of said tab.

5. The child-resistant closure as set forth in claim 2, wherein;

said elongate arm includes a bottom portion articulated to said bottom member annular side wall and a top portion providing a planner surface perpendicular to the axis of said closure and an upstanding hook parallel to said axis of said closure, said elongate arm top portion including a front wall formed radially outward from the elongate arm bottom member, said front wall tapered axially upward and radially outward.

6. The child-resistant closure as set forth in claim 2, wherein;

said top lid member engagement means includes a radially outward extending tab formed therewith said top lid member, said top lid member tab includes a planner bottom surface adapted to engage within a top portion of said bottom member side wall channel when said top lid member is in a closed position, said tab includes an opening formed therein adapted to include a bottom ledge engageable with said elongate arm distal end hook when said top lid member is in a closed position and said elongate arm distal and hook is in a radially outward position and further adapted to be disengaged by said elongate arm distal end hook when said elongate arm is pressed radially inward.

7. The child-resistant closure as set forth in claim 2, wherein;

said bottom member mouth portion includes an annular rim within said bottom member mouth portion adapted for sealing engagement of a container mouth portion.

8. The child-resistant closure as set forth in claim 2, wherein;

said elongate arm distal end hook includes a top surface tapered radially outward and axially downward from said terminus of said hook and a planner bottom surface essentially perpendicular to said axis of said bottom member when said elongate arm is in a relative radial outermost position, said elongate arm distal end hook includes a laterally extending slot formed thereunder on said inner wall of said elongate arm such that said distal end hook tapered top surface and said elongate arm lateral slot co-operatively cause said distal end hook to yieldingly bend axially downward and radially inward when said top lid member engagement means obstructivly encounter said distal end hook as said top lid member is moved towards a closed position from an open position.

9. The child-resistant closure as set forth in claim 2, wherein;

said bottom member annular side wall channel includes a surface formed therein adapted to abut said elongate arm as said elongate arm is depressed to prevent radial inward movement of said elongate arm before said terminus hook is disengageable from said top lid member engagement means, said surface adapted to allow radial inward movement of said elongate arm when said elongate arm is displaced laterally.

10. The child-resistant closure as set forth in claim 2, wherein;

said mouth portion of said bottom member includes a planar deck to reduce the size of said mouth portion to a dispensing orifice, said dispensing orifice adapted to receive a depending plug formed on said top lid member when said top lid member is in a closed position to form a sealing engagement therewith.

11. A one-piece child-resistant container, comprising: a bottom member including an annular side wall and an end wall closing one end of said bottom member, said bottom member including a mouth portion;

a top lid member adapted to engage therein said bottom member mouth portion when said top lid member is in a closed position;

hinge means connecting said bottom and top lid members, said hinge means adapted to allow said top lid member relative axial outward movement as said top lid member is urged from a closed to an open position, said hinge means adapted to be formed co-jointly with said bottom and top lid members;

said bottom member including an elongate arm articulated to said bottom member side wall on one end to provide a pivot whereby said elongate arm may be rotated from a position essentially perpendicular to said axis of said closure to a position at an acute angle to said axis of said closure, said elongate arm including a distal hook on said terminus thereof;

said bottom member including an exterior side wall with a channel formed therein, said channel adapted to movably receive said elongate arm and provide unobstructive clearance thereto to allow said elongate arm to move radially inward, said channel including a front interior wall;

said elongate arm including obstructive means formed thereon to engage behind said channel front interior wall when said elongate arm is folded thereinto said channel to obstruct relative radial outward movement of said elongate arm radially outward beyond said bottom member channel;

means formed thereon either of said elongate arm or bottom members adapted to direct radial inward force applied thereto said elongate arm for deformation of either of said elongate arm or bottom members, said means adapted to yeildingly urge said elongate arm towards a relative radial outward position;

engagement means formed thereon said top lid member adapted to be engaged by said elongate arm hook when said top lid member is in a closed position, said top lid member engagement means adapted to disengage said elongate arm hook when said elongate arm is depressed radially inward, said top lid member engagement means adapted to provide unobstructive access to a portion thereof when said elongate arm is depressed radially inwards so said top lid member may be urged axially outward to an open position.

12. The child-resistant container as set forth in claim 11, wherein:

said bottom side wall channel is formed by two upstanding opposing structures formed radially outward and axially upward from a position where said elongate arm adjoins said bottom member sidewall, said opposing structures formed so as to provide an open space between them equidistant with the width of said elongate arm such that said elongate arm is movably received in the open space, said opposing structures formed with a radially outward wall having equal thickness with said elongate arm.

13. The child-resistant container as set forth in claim 11, wherein;

said elongate arm obstructive means includes at least one tab extending laterally outward from said interior wall of said elongate arm, said tab having a planner radial outward front surface and a back surface tapered radially inward and laterally inward from said outer edge of said wall of said elongate arm, said tab having a planner radial outward front surface and a back surface tapered radially inward and laterally inward from the outer edge of said tab.

14. The child-resistant container as set forth in claim 11, wherein;

said elongate arm includes a bottom portion articulated to said bottom member annular side wall and a top portion providing a planner surface perpendicular to the axis of said closure and an upstanding hook parallel to said axis of said closure, said elongate arm top portion including a front wall formed radially outward from said elongate arm bottom member, said front wall tapered axially upward and radially outward.

15. The child-resistant container as set forth in claim 11, wherein;

said top lid member engagement means includes a radially outward extending tab formed therewith said top lid member, said top lid member tab includes a planner bottom surface adapted to engage within a top portion of said bottom member side wall channel when said top lid member is in a closed position; tab including an opening formed therein adapted to include a bottom ledge engageable with said elongate arm distal end hook when said top lid member is in a closed position and said elongate arm distal hook is in a radially outward position and further adapted to be disengaged by said elongate arm distal end hook when said elongate arm is pressed radially inward.

16. The child-resistant contained as set forth in claim 11, wherein;

said elongate arm distal end hook includes a top surface tapered radially outward and axially downward from said terminus of said hook and a planner bottom surface essentially perpendicular to said axis of said bottom member when said elongate arm is in a relative radial outermost position, said elongate arm distal end hook includes a laterally extending slot formed thereunder on said inner wall of said elongate arm such that said distal end hook tapered top surface and said elongate arm lateral slot co-operatively cause said distal end hook to yieldingly bend axially downward and radially inward when said top lid member engagement means obstructivley encounter said distal end hook as said top lid member is moved towards a closed position from an open position.

* * * * *

UNITED STATES PATENT AND TRADEMARK OFFICE

CERTIFICATE OF CORRECTION

PATENT NO. : 5,031,784

DATED : July 16, 1991

INVENTOR(S) : Frank S. Wright

It is certified that error appears in the above-identified patent and that said Letters Patent is hereby corrected as shown below:

Title page: Inventor, correct address should read--

Frank S. Wright, 139 Hendricks Blvd. apt. 5,
Chattanooga, TN 37405

Signed and Sealed this

Eleventh Day of February, 1992

*Attest:*

HARRY F. MANBECK, JR.

*Attesting Officer*

*Commissioner of Patents and Trademarks*